US006196486B1

(12) United States Patent
David et al.

(10) Patent No.: US 6,196,486 B1
(45) Date of Patent: Mar. 6, 2001

(54) COUNTERWEIGHTED WIRE-COILING HEAD

(75) Inventors: Siegfried David; Karl Keller, both of Hilchenbach (DE)

(73) Assignee: SMS Schloemann-Siemag AG, Dusseldorf (DE)

( * ) Notice: Subject to any disclaimer, the term of this patent is extended or adjusted under 35 U.S.C. 154(b) by 0 days.

(21) Appl. No.: 09/327,990

(22) Filed: Jun. 8, 1999

(30) Foreign Application Priority Data

Jun. 19, 1998 (DE) ..... 198 27 348

(51) Int. Cl.[7] ..... B21C 47/14
(52) U.S. Cl. ..... 242/361
(58) Field of Search ..... 242/361, 361.1, 242/361.2, 361.3, 361.4

(56) References Cited

U.S. PATENT DOCUMENTS 3,039,715 * 6/1962 Caperton .
3,669,377 * 6/1972 Gilvar et al. .
4,189,106 * 2/1980 Weis .
4,242,892 * 1/1981 Wykes et al. .
4,432,503 * 2/1984 Wedler .
4,765,556 * 8/1988 Nasrah .
5,024,390 * 6/1991 Enderlin .
5,312,065 * 5/1994 Shore et al. .
5,911,381 * 6/1999 Wacinski et al. .

* cited by examiner

*Primary Examiner*—Katherine A. Matecki
(74) *Attorney, Agent, or Firm*—Herbert Dubno; Andrew Wilford

(57) ABSTRACT

A coil-laying head for a wire-coiling apparatus has a tubular body centered on and rotatable about an axis, a generally spiral guide tube having an inlet end at the axis and an outlet end opening generally tangentially of the axis at a radial spacing from the axis, and a helicoidal mounting plate having an inner edge fixed to the body and an outer edge secured to the tube. A helicoidal counterweight plate is fixed to the tubular body diametrally opposite the mounting plate and has radial and axial dimensions, at least one of which varies such that any section of the counterweight plate counterbalances a corresponding diametrally opposite section of the guide tube and mounting plate. The counterweight plate has a resonant frequency and the body has a nominal maximum rotation speed that is less than the resonant frequency.

4 Claims, 1 Drawing Sheet

COUNTERWEIGHTED WIRE-COILING HEAD

FIELD OF THE INVENTION

The present invention relates to a wire-coiling apparatus. More particularly this invention concerns a counterweighted wire-laying head for such an apparatus.

BACKGROUND OF THE INVENTION

Wire or rod (hereinafter termed "wire" only) is formed at high speed in a rolling or drawing mill and is delivered in straight condition to a coiler that forms it into a succession of large-diameter turns that it deposits on a surface, normally a conveyor of some type. Thence the coiled wire is moved through subsequent treatment steps such as heat treatment, descaling, pickling, or simply cooling. It is critical that the wire be deposited in uniformly shaped and spaced coils so that the subsequent treatment stage is effective.

The typical coiling system comprises a coiler head carrying a guide tube twisted in three dimensions and having an upstream end opening axially in line with an axis about which the head is rotated and a downstream end which opens at a location radially offset from the axis and directed generally tangentially. The straight wire is fed into the upstream end of the guide tube as the head is rotated about its axis so that as the wire passes through the tube it is bent into an arcuate shape and will fall in a coil when leaving the downstream end of the tube.

The guide tube is of uniform cross-section but starts at a location at the axis directed axially upstream and moves through a spiral to a location spaced well out from the axis and opening tangentially, so that it forms a complexly oriented offcenter mass between its ends. The tube is carried on the outer edge of a thin helical mounting plate having an inner edge secured on a helix on the support tube and an outer edge that diverges from the axis downstream and that is clipped to the guide tube. Obviously if the coil-laying head is rotated at high speed there will be considerable throw.

Accordingly it is standard practice to provide a plurality of counterweight blocks and/or several axially extending counterweight ribs on the support tube. Such arrangements make at best an approximation of uniform distribution of mass about the axis, creating some vibration at high speeds. Furthermore they are subject to deformation when in use and any offcenter problems are often aggravated.

In another known system a spiral rod mounted on a helical mounting plate is provided diametrally opposite the guide tube so as to offset its mass. Constructing such a counterweighted head is very difficult as the parts must be welded together and many of the seam areas are very difficult to get into. In addition this system is only partially effective since at high speeds the stiffening plates deform and allow their centers of mass to move somewhat, and the thermal expansion occurring during operation also causes deformations that displace the various centers of mass.

OBJECTS OF THE INVENTION

It is therefore an object of the present invention to provide an improved coil-laying head for a wire-coiling apparatus.

Another object is the provision of such an improved coil-laying head for a wire-coiling apparatus which overcomes the above-given disadvantages, that is which is perfectly balanced on axis and remains so even when operated at high speed.

SUMMARY OF THE INVENTION

A coil-laying head for a wire-coiling apparatus has according to the invention a tubular body centered on and rotatable about an axis, a generally spiral guide tube having an inlet end at the axis and an outlet end opening generally tangentially of the axis at a radial spacing from the axis, and a helicoidal mounting plate having an inner edge fixed to the body and an outer edge secured to the tube. In accordance with the invention a helicoidal counterweight plate is fixed to the tubular body diametrally opposite the mounting plate and has radial and axial dimensions, at least one of which varies such that any section of the counterweight plate counterbalances a corresponding diametrally opposite section of the guide tube and mounting plate. This counterweight plate is substantially free of any other structure and can be built to exactly counterbalance the off center mass of the spiral guide tube, its mounting wall, and any attachment hardware between them.

Such a structure is extremely stable and will not vibrate at all when rotated. The counterweight plate is a relatively simple structure having substantially the same shape as the mounting plate, but somewhat thicker.

In accordance with the invention the counterweight plate has a resonance frequency and the body has a nominal maximum rotation speed that is less than the resonance frequency. Thus so long as the rotation rate of the head does not exceed its nominal rating, the counterweight plate will not vibrate and therefore will not need axial stiffening gussets.

At least two stiffening plates each lying in a plane including the axis each have an axially directed edge fixed to the mounting plate and a radially inwardly directed edge fixed to the body. Furthermore the counterweight plate is of uniform axial dimension and of varying radial height.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
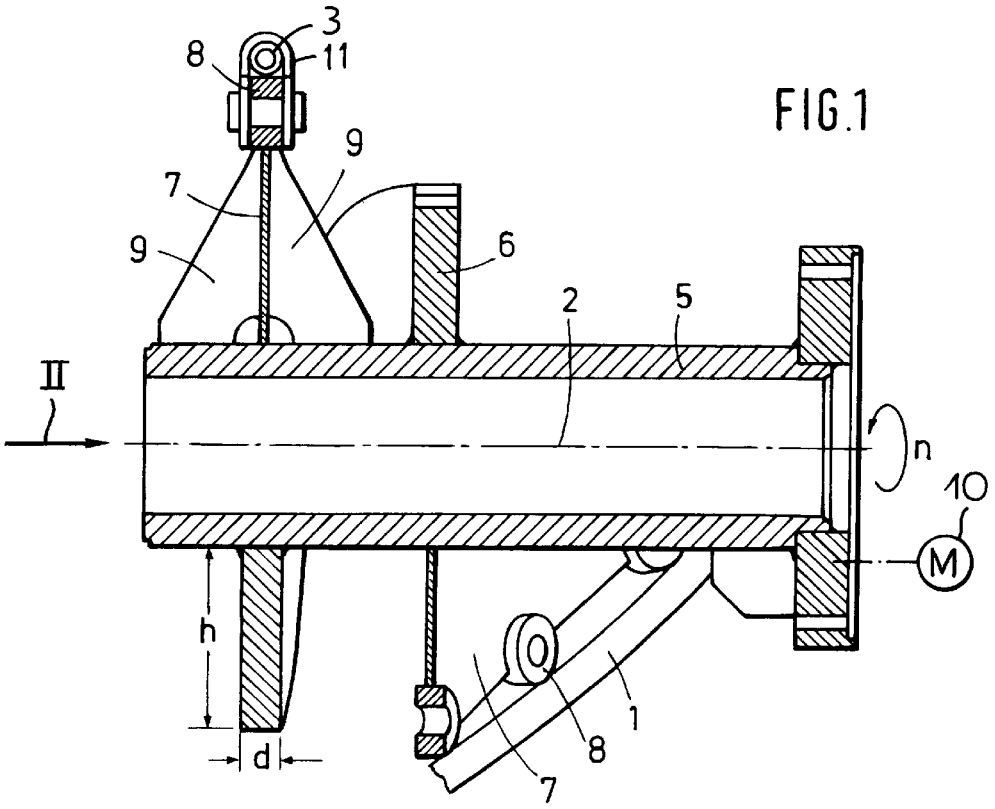
FIG. 1 is an axial section through the coil-laying head according to the invention.
Figure 2:
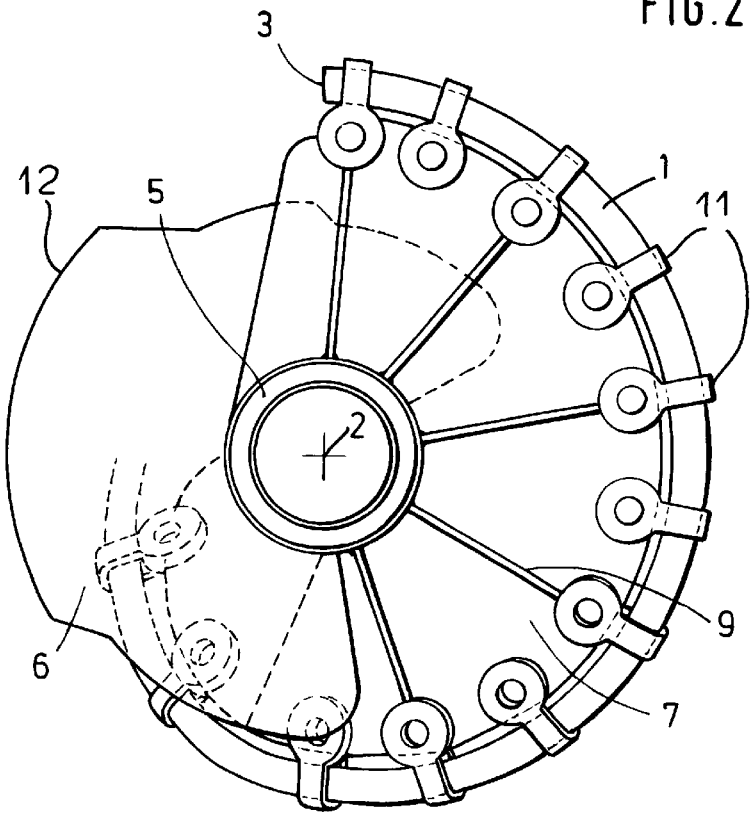
FIG. 2 is an end view taken in the direction of arrow II of FIG. 1.

As seen in FIGS. 1 and 2 a head for a coil-laying machine has a basically tubular body 5 centered on and rotated by a motor illustrated schematically at 10 about an axis 2 at a rate of at most n RPM. A spiral guide tube 1 has one end (not visible in the drawing) that opens axially on the axis 2 and an opposite outlet end 3 that opens tangentially at some spacing from the axis 2. This tube 1 is secured by clips 11 to eyes 8 carried on the outer periphery of a relatively thin helicoidal mounting plate 7. Generally triangular and thin stiffening plates 9 each lying in a plane including the axis 2 are braced against opposite faces of the plate 7 at the outlet end 3 to prevent axial deflection of this plate 7.

According to the invention a helicoidal counterweight plate 6 of about the same angular extent and general shape as the plate 7 is mounted on the tubular support body 2, but diametrically opposite it. The plate 6 is of simple construction and carries no hardware or other structure; it functions purely as a counterweight. This plate 6 has a radial height h and an axial thickness d that vary along its length, but being in all instances many times greater than the axial thickness of the plate 7. These dimensions h and d vary so that the plate 6 forms a perfect counterweight to the mass of the parts 1, 7, 8, and 9. In other words for any given section of the parts 1, 7, 8, and 9 of a predetermined angular dimension, there is a corresponding section of identical angular dimension directly diametrally opposite it with the same mass. Normally the thickness d is left the same but the height h is varied as visible at edge 12 in FIG. 2 to establish the desired amount of mass in a region diametrally opposite a similar part of the plate 7 and tube 1 and associated hardware.

The dimensions d and h and the composition of the plate 6, here of steel, are such that it has a resonant frequency f that is substantially more than the nominal rotation speed n of the head. Such tuning of the system means that, so long as the rotation speed n of the head remains below the resonant frequency f, there will be nothing to set up a standing vibration wave in the head. Thus no axial stiffeners are needed for the plate 6 and the welds between the plates 9 and 7 are stressed only somewhat in tension, not in compression at all. In fact it is possible to do away with such stiffening plates 9 except at the outlet 3 in many systems.

We claim:

1. A coil-laying head for a wire-coiling apparatus, the coiling head comprising:

a tubular body centered on and rotatable about an axis;

a generally spiral guide tube having an inlet end at the axis and an outlet end opening generally tangentially of the axis at a radial spacing from the axis;

a helicoidal mounting plate having an inner edge fixed to the body and an outer edge secured to the tube; and a helicoidal counterweight plate fixed to the tubular body diametrally opposite the mounting plate and having radial and axial dimensions, at least one of the dimensions varying such that any section of the counterweight plate counterbalances a corresponding diametrally opposite section of the guide tube and mounting plate.

2. The coil-laying head defined in claim 1, further comprising at least two stiffening plates each lying in a plane including the axis and each having an axially directed edge fixed to the mounting plate and a radially inwardly directed edge fixed to the body.

3. The coil-laying head defined in claim 1 wherein the counterweight plate is of uniform axial dimension and of varying radial height.

4. A coil-laying head for a wire-coiling apparatus, the coiling head comprising:

a tubular body centered on and rotatable about an axis;

a generally spiral guide tube having an inlet end at the axis and an outlet end opening generally tangentially of the axis at a radial spacing from the axis;

a helicoidal mounting plate having an inner edge fixed to the body, an outer edge secured to the tube, and a nominal maximum rotation speed; and a helicoidal counterweight plate fixed to the tubular body diametrally opposite the mounting plate, having a resonant frequency greater than the nominal maximum rotation speed of the mounting plate, and having radial and axial dimensions, at least one of the dimensions varying such that any section of the counterweight plate counterbalances a corresponding diametrally opposite section of the guide tube and mounting plate.

* * * * *